US010906775B2

(12) United States Patent
Schoenauer

(10) Patent No.: US 10,906,775 B2
(45) Date of Patent: Feb. 2, 2021

(54) ELEVATOR CONTROL SYSTEM AND METHOD OF OPERATING AN ELEVATOR SYSTEM

(71) Applicants: Uwe Schoenauer, Berlin (DE); Otis Elevator Company, Farmington, CT (US)

(72) Inventor: Uwe Schoenauer, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 534 days.

(21) Appl. No.: 15/752,966

(22) PCT Filed: Aug. 19, 2015

(86) PCT No.: PCT/EP2015/069079
§ 371 (c)(1),
(2) Date: Feb. 15, 2018

(87) PCT Pub. No.: WO2017/028919
PCT Pub. Date: Feb. 23, 2017

(65) Prior Publication Data

US 2018/0362297 A1 Dec. 20, 2018

(51) Int. Cl.
*B66B 5/00* (2006.01)
*B66B 1/00* (2006.01)
(Continued)

(52) U.S. Cl.
CPC ..... *B66B 5/0018* (2013.01); *B66B 1/28* (2013.01); *B66B 1/3492* (2013.01); *B66B 1/36* (2013.01);
(Continued)

(58) Field of Classification Search
CPC ..... B66B 1/3492; B66B 5/0031; B66B 5/02; B66B 5/0018; B66B 3/002; B66B 3/02; B66B 5/0006; B66B 13/24; B66B 17/00
See application file for complete search history.

(56) References Cited

U.S. PATENT DOCUMENTS 5,677,519 A * 10/1997 Herkel ..... B66B 1/3492 187/291
6,123,176 A 9/2000 O'Donnell et al.
(Continued)

FOREIGN PATENT DOCUMENTS

CN 1073655 A 6/1993
CN 1160014 A 9/1997
(Continued)

OTHER PUBLICATIONS

Chinese First Office Action and Search Report for application CN 201580082479.0, dated Jan. 15, 2019, 5 pages.
(Continued)

*Primary Examiner* — Marlon T Fletcher
(74) *Attorney, Agent, or Firm* — Cantor Colburn LLP

(57) ABSTRACT

Disclosed is an elevator control system configured to control movement of an elevator car (12) along an elevator hoistway (26) between a starting position and a destination position (L2), the control system comprising a car holding position monitoring unit configured to monitor whether the elevator car (12) has moved upwards or downwards in the hoistway (26) during a holding period (68) where the car (12) was intended to remain stationary at the destination position (L2). The car holding position monitoring unit is configured to: Receive a first trigger signal (62) from a first car position reference system (40); upon receipt of the first trigger signal, receive signals from a further car position reference system to detect a first indicator (66) indicative of a travel distance (X2) between the position of the elevator car (12) in the
(Continued)

hoistway (26) when receiving the first trigger signal (62) and the position of the elevator car (12) in the hoistway (26) when stopping at the destination position (L2); upon receipt of a further service call for the elevator car (12), receive further signals from the further car position reference system and receive a second trigger signal (70A) from the first car position reference system (40) to detect a second indicator (74A) indicative of a travel distance between the position of the elevator car (12) in the hoistway (26) at the end of the holding period (68) and the position of the elevator car (12) in the hoistway (26) when the elevator car (12) receives the second trigger signal (72A) from the first car position reference system (40); and detect whether the elevator car (12) has moved during the holding period (68) based on a comparison of the first indicator (66) and the second indicator (74A).

20 Claims, 4 Drawing Sheets

(51) Int. Cl.

| | |
|---|---|
| ***B66B 1/28*** | (2006.01) |
| ***B66B 1/34*** | (2006.01) |
| ***B66B 1/36*** | (2006.01) |
| ***B66B 9/00*** | (2006.01) |
| ***B66B 13/16*** | (2006.01) |

(52) U.S. Cl.
CPC ..... *B66B 5/0037* (2013.01); *B66B 9/00* (2013.01); *B66B 13/165* (2013.01)

(56) References Cited

U.S. PATENT DOCUMENTS

| | | | | |
|---|---|---|---|---|
| 6,325,179 | B1 | 12/2001 | Barreiro et al. | |
| 6,701,277 | B2 | 3/2004 | Coste et al. | |
| 7,353,916 | B2 | 4/2008 | Angst | |
| 7,597,176 | B2 | 10/2009 | Zaharia | |
| 8,336,677 | B2 | 12/2012 | Kigawa | |
| 8,752,677 | B2 | 6/2014 | Harkonen et al. | |
| 8,869,945 | B2 | 10/2014 | Härkönen et al. | |
| 9,878,878 | B2 * | 1/2018 | Saarelainen | B66B 7/1215 |
| 2005/0269163 | A1 * | 12/2005 | Angst | B66B 5/0031 187/287 |
| 2013/0213742 | A1 * | 8/2013 | Hakala | B66B 1/24 187/247 |
| 2014/0000985 | A1 * | 1/2014 | Fukui | B66B 7/06 187/247 |
| 2014/0058700 | A1 | 2/2014 | Gehrke | |
| 2015/0321882 | A1 * | 11/2015 | Pursiainen | B66B 5/0068 187/336 |
| 2015/0329321 | A1 * | 11/2015 | Hovi | B66B 5/0093 187/247 |
| 2018/0201477 | A1 * | 7/2018 | Shibata | B66B 5/06 |
| 2019/0062106 | A1 * | 2/2019 | Ginsberg | B66B 1/3492 |

FOREIGN PATENT DOCUMENTS

| | | | |
|---|---|---|---|
| CN | 102947210 | A | 2/2013 |
| EP | 1749780 | A1 | 2/2007 |
| EP | 1880966 | A1 | 1/2008 |
| EP | 1705147 | B1 | 5/2008 |
| EP | 2272783 | B1 | 9/2012 |
| EP | 2380838 | B1 | 3/2013 |
| EP | 2583928 | A1 | 4/2013 |
| EP | 1792865 | B1 | 6/2013 |
| EP | 1980519 | B1 | 7/2014 |
| EP | 2774886 | A1 | 9/2014 |
| EP | 2217342 | B1 | 11/2014 |
| EP | 2614027 | B1 | 1/2015 |
| EP | 2743225 | B1 | 2/2016 |
| JP | 2006131402 | A | 5/2006 |
| JP | 4849465 | B2 | 1/2012 |
| JP | 5326474 | B2 | 10/2013 |
| WO | 2014109731 | A1 | 7/2014 |
| WO | 2014128347 | A1 | 8/2014 |
| WO | 2015083407 | A1 | 6/2015 |

OTHER PUBLICATIONS

International Search Report and Written Opinion for application PCT/EP2015/069079, dated May 10, 2016, 12 pages.

Wheat, Johnny, "Hazard Monitoring Equipment Selection, Installation and Maintenance", Mar. 22, 2007 4B Components, Ltd., 34 pages.

* cited by examiner

ELEVATOR CONTROL SYSTEM AND METHOD OF OPERATING AN ELEVATOR SYSTEM

The present disclosure relates to an elevator control system and a method of operating an elevator system.

Elevator systems move an elevator car along a hoistway to transport passengers between different landings. In a traction elevator, the car is driven by way of traction between a traction sheave and a tension member, e.g. a rope or a belt. The traction sheave is driven by a motor rotationally coupled to the traction sheave. The traction sheave is frictionally engaged by the tension member such that rotation of the traction sheave is transferred into linear movement of the tension member around the traction sheave. The tension member is coupled to an elevator car and in most cases also to a counterweight such that linear movement of the tension member leads to upward or downward movement of the elevator car in the hoistway. In case a counterweight is present, the elevator car and the counterweight move in opposite directions along the hoistway.

When the elevator car has reached a desired landing, rotation of the traction sheave is stopped. Usually, the rotational position of the traction sheave is secured by way of a holding brake engaging the traction sheave or the drive train between the motor and the traction sheave. Due to the frictional engagement of the tension member with the traction sheave, the car remains in its position at the desired landing, even for long holding times.

While traditionally uncoated steel wire ropes have been used as tension members in traction drive elevators, other tension member configurations have become popular in recent years. Among these, there are configurations of tension members having load bearing cords (e.g. made from steel wires or made from synthetic fibers) and a coating around the load bearing cords. Such tension members may have the shape of a traditional rope. A particularly popular tension member configuration comprises coated belt tension members having the shape of a belt and comprising a plurality of load bearing cords (e.g. made from steel wires or made from synthetic fibers) arranged parallel to each other side by side and separated by the coating. In such configurations, the traction surface of the traction sheave frictionally engages the coating of the tension member when the tension member runs over the traction sheave. Usually the coating is a polymer coating, e.g. made from polyurethanes and/or synthetic rubbers.

While the frictional engagement between a steel wire rope and a steel traction sheave is well understood, less experience exists for the frictional engagement of polymer coated tension members with the traction sheave. A particular concern is whether in such configurations the frictional engagement might be subject to change under conditions where the tension member statically engages the traction sheave over an extended period of time. In an elevator system, such situation might occur in situations where the car is stopped at a landing for a longer period of time until a new call is assigned to the car (e.g. when the elevator car has serviced a last call and stays at the destination landing unused overnight, until it receives the first call the next morning). In such situation, the frictional engagement of the tension member with the traction sheave has to be sufficiently large to balance the weight of the car or any weight difference between the car and the counterweight. Otherwise the car will move some distance up or down in the hoistway. If there is a counterweight and the car is empty, loss of frictional engagement between the tension member and the traction sheave will usually cause the car to move upwards, since the weight of the counterweight is normally equal to the weight of the empty car plus the half nominal load of the car. When the car doors open in response to a call and the car has moved upwards for several centimeters, this will create a step with respect to the landing floor, and thus a potential safety hazard to passengers entering the car.

It would be beneficial to provide an elevator control system and an elevator system which allows to detect whether the frictional engagement between the traction sheave and the tension member is sufficiently large to prevent movement of the car upwards or downwards in the hoistway in a situation where the car should stop at a desired position in the hoistway, even in a situation where the car is intended to remain at one position in the hoistway over an extended period of time.

Embodiments described herein provide an elevator control system, comprising an elevator control system configured to control movement of an elevator car along an elevator hoistway between a starting position and a destination position, the control system comprising a car holding position monitoring unit configured to monitor whether the elevator car has moved upwards or downwards in the hoistway during a holding period. The car holding position monitoring unit is configured to: Receive a first trigger signal from a first car position reference system; upon receipt of the first trigger signal, receive a signal from a further car position reference system to detect a first indicator indicative of the travel distance between the position of the elevator car in the hoistway when receiving the first trigger signal and the position of the elevator car in the hoistway when stopping at the destination position; upon receipt of a further service call for the elevator car, receive a further signal from the further car position reference system and a second trigger signal from the first car position reference system to detect a second indicator indicative of a travel distance between the position of the elevator car in the hoistway at the end of the holding period and the position of the elevator car in the hoistway when the elevator car receives the second trigger signal from the first car position reference system; and detect whether the elevator car has moved during the holding period based on a comparison of the first indicator and the second indicator.

Further embodiments may include an elevator system comprising a drive machine, a tension member coupled to the drive machine and to an elevator car, such as to move the elevator car in vertical direction between landings, and an elevator control system according to any of the previous embodiment. In further embodiments, the elevator system may be a traction drive elevator system comprising a drive machine having a traction sheave rotationally coupled to a drive motor, the tension member running over the traction sheave and frictionally engaging a traction surface of the traction sheave in its section running over the traction sheave; the elevator system further comprising a holding brake engaging the drive machine for holding the elevator car at a desired position. In embodiments, the holding brake may be configured to engage the traction sheave or a drive shaft to which the traction sheave is rotationally coupled.

Further embodiments disclosed herein relate to a method of controlling movement of an elevator car along an elevator hoistway between a starting position and a destination position, the method comprising monitoring whether the elevator car has moved upwards or downwards in the hoistway during a holding period by carrying out the following steps: Receiving a first trigger signal from a first car position reference system; upon receipt of the first trigger signal, receiving signals from a further car position reference system to detect a first indicator indicative of a travel distance between the position of the elevator car in the hoistway when receiving the first trigger signal and the position of the elevator car in the hoistway when stopping at the destination position, upon receipt of a further service call for the elevator car, receiving further signals from the further car position reference system and receiving a second trigger signal from the first car position reference system to detect a second indicator indicative of a travel distance between the position of the elevator car in the hoistway at the end of the holding period and the position of the elevator car in the hoistway when the elevator car receives the second trigger signal from the first car position reference system; and detecting whether the elevator car has moved during the holding period based on a comparison of the first indicator and the second indicator.

Particular aspects and embodiments are described in more detail by way of exemplary embodiments as shown in the figures.

Figure 1:
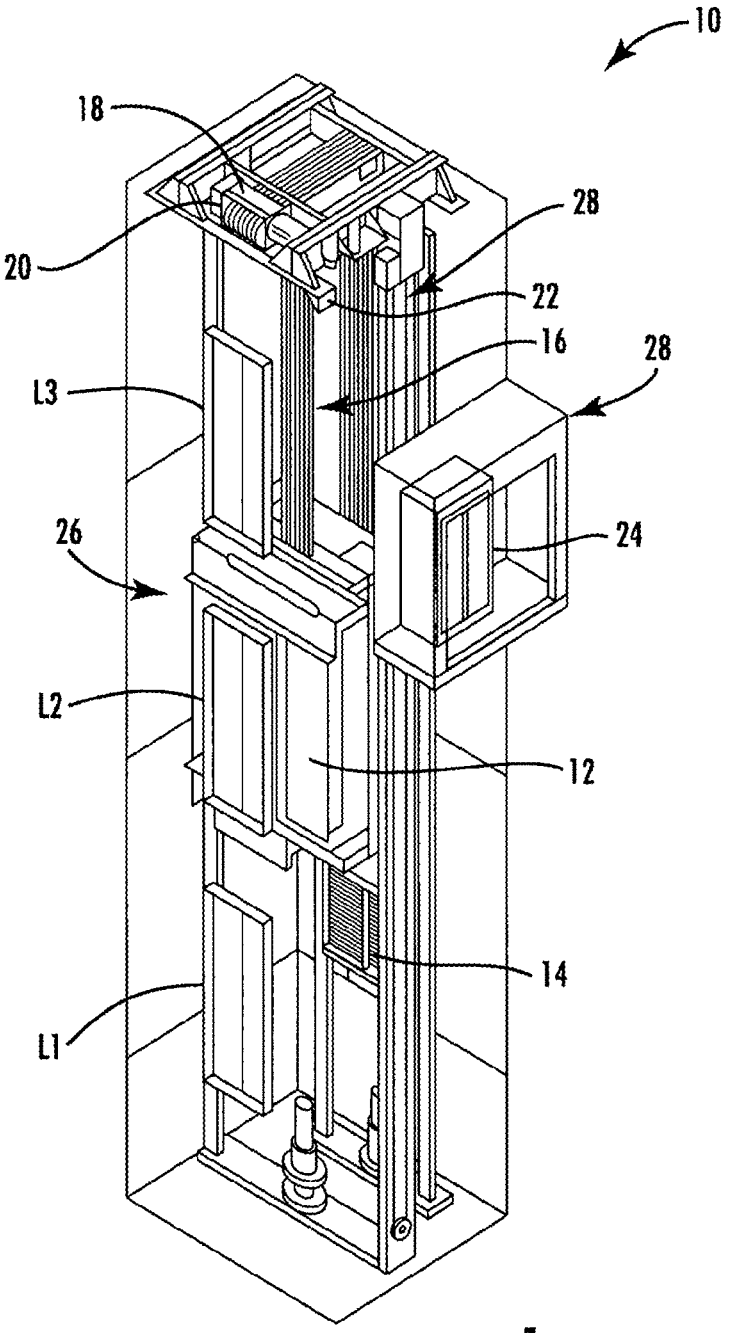
FIG. 1 is a perspective view of an elevator system including an elevator car and a counterweight connected to the elevator car by a polymer coated tension member.

FIG. 1 is a perspective view of an elevator system 10 including an elevator car 12, a counterweight 14, a tension member 16, an elevator hoist machine 18, a machine-based car position reference system 20, a limit switch 22, and a controller 24. Elevator car 12 and counterweight 14 are connected with tension members 16 and suspended in a hoistway 26 including landings L1, L2, and L3. The tension members 16 are polymer coated tension members having a polymer coating in which a plurality of load carrying cords are embedded. The coating is made from polyurethane. The load bearing cords are made of steel wires twisted together to form strands, the strands twisted to form the load bearing cords, respectively. The tension members 16 have the configuration of belts, respectively, with a plurality of load bearing cords arranged next to each other side by side and separated by the polyurethane coating.

The elevator car 12 and the counterweight 14 are interconnected by the tension members 16 to move concurrently and in opposite directions within the hoistway 26. In the embodiment shown the tension members 16 suspend the elevator car 12 and the counterweight 14 in the configuration of a 1:1 roping. Other roping configurations are conceivable, particularly a 2:1 roping configuration, or even higher roping configuration such as 4:1 roping. The counterweight 14 balances the load of the elevator car 12 and facilitates movement of the elevator car 12. In one embodiment, the counterweight 14 has a mass approximately equal to the mass of the elevator car 12 plus one half of the maximum rated load of the elevator car 12. The tension members 16 engage the elevator hoist machine 18, which controls movement of the elevator car 12 and the counterweight 14.

The limit switch 22 is actuated by a cam (not shown) that rides with the elevator car 12 to ensure that the elevator car 12 does not run into the overhead structure of the hoistway, where the elevator hoist machine 18 is mounted. The limit switch 22 is actuated when the elevator car 12 moves upwardly past the top landing L3. The limit switch 22 may be a mechanically actuated lever or switch, or an electrical switch that is actuated when the car mounted cam comes into electrical contact with the limit switch 22. When actuated by the elevator car 12, the limit switch 22 provides a signal to the elevator controller 24 to remove power to hoist machine 18, which prevents all further travel of the car 12 and counterweight 14 in either direction. The elevator system 10 may include additional limit switches to prevent the elevator car 12 from running into the top or bottom portions of the hoistway 26.

The controller 24, which is located in a controller space 28 in the hoistway 26, provides signals to the elevator hoist machine 18 to control acceleration, deceleration, leveling, and stopping of the elevator car 12. The controller 24 also receives signals from the machine-based car position encoder 20 and limit switch 22.

Figure 2:
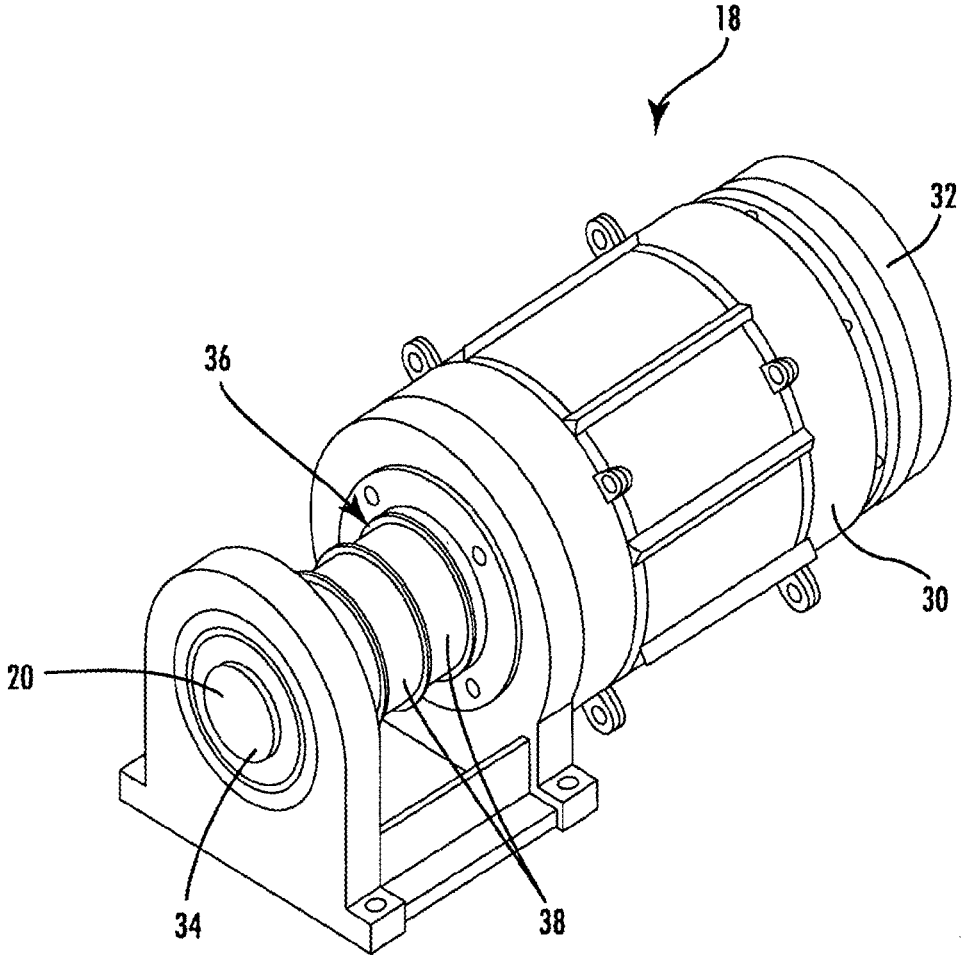
FIG. 2 is a schematic view of an elevator hoist machine for controlling movement of the elevator car and the counterweight.

FIG. 2 is a detailed perspective view of the elevator hoist machine 18 for controlling movement of the elevator car 12 and the counterweight 14. The elevator hoist machine 18 includes a motor 30, a brake 32, a drive shaft 34, and a traction sheave 36. The drive shaft 34 projects from the motor 30. The traction sheave 36 is fixedly disposed on the drive shaft 34. In some embodiments, the drive sheave 36 may be formed integrally with the drive shaft 34. The brake 32 is positioned adjacent to the motor 30 at the opposite end of the drive shaft 34 with respect to the traction sheave 36. The brake 32 could alternatively be located on a side opposite the traction sheave 36 with respect to the motor 30. The traction sheave 36 includes traction surfaces 38 for mechanically engaging the tension members 16, respectively (the tension members 16 are not shown in FIG. 2).

The drive shaft 34 is driven by the motor 30. Such rotation causes the traction sheave 36 to rotate. This causes linear movement of the elevator car 12 and the counterweight 14 due to friction between the tension members 16 and the traction surfaces 38 of the traction sheave 36. The motor 30 drives the drive shaft 34 based on signals received from the controller 24. The magnitude and direction of force (i.e., torque) provided by the motor 30 on the tension members 16 controls the speed and direction of movement of the elevator car 12, as well as the acceleration and deceleration of the elevator car 12.

When the elevator car 12 is stopped (e.g. in case it has reached its destination landing), the brake 32 engages the drive shaft 34 to prevent any further movement of the elevator car 12. In one embodiment, the brake 32 may be a drum brake including a drum with two internal pads that are biased into engagement by heavy springs and are caused to disengage by electromagnetic force. Other brake configurations known in the art are conceivable as well. When the brake 32 is engaged, a torque is exerted on the brake 32 that is caused by the relative weights of the elevator car 12 and the counterweight 14. In particular, if the overall mass of the elevator car 12 (i.e., the mass of the elevator car 12 plus the load therein) is greater than the mass of the counterweight 14, a torque is exerted on the brake 32 in one direction. Conversely, if the mass of the counterweight 14 is greater than the overall mass of the elevator car 12, a torque is exerted on the brake 32 in the opposite direction.

The machine-based car position reference system 20 is mounted to the hoist machine 18 such as to detect a rotational angle of at least one component of the hoist machine 18, e.g. of the drive shaft 34 or the traction sheave 36. In one embodiment the machine-based car position reference system 20 may include a rotation angle encoder mounted at one end of the drive shaft 34, e.g. the end opposite the brake 32 (front end in FIG. 2) and a corresponding rotation angle sensor. The machine-based car position reference system 20 provides signals to the controller 24 related to the position of the elevator car 12 within the hoistway 26 by detecting the rotational angle of the component of the hoist machine (drive shaft 34 or traction sheave 36). Thereby, the machine-based car position reference system 20 is configured to provide continuous car position information based on the rotational motion of at least one component on the machine side, i.e. the part of the drive upstream of the traction surface 38 where the rotational motion of the traction sheave 36 is transmitted to the tension member 16.

Figure 3A:
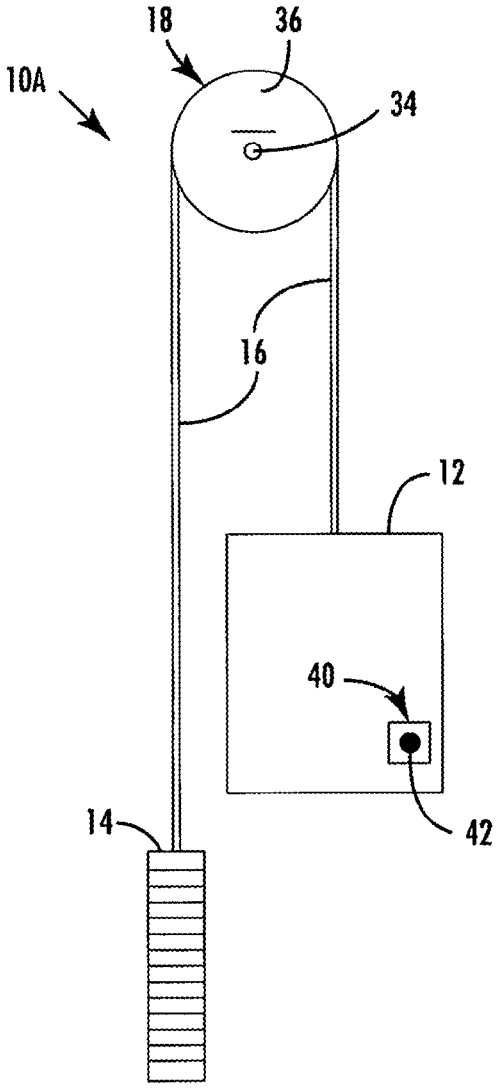
FIG. 3A is a highly schematic diagram of a portion of the elevator system showing the hoist machine, the tension member, the counterweight, and the elevator car including a position sensing unit of a hoistway based car position reference system.
Figure 3B:
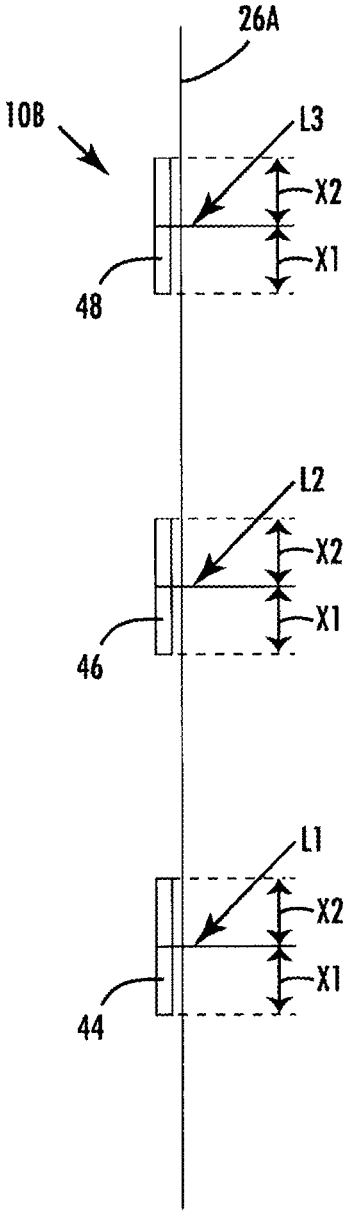
FIG. 3B is a further highly schematic diagram of a portion of the elevator system showing a hoistway wall, a number of landings and a number of car position switching elements of the hoistway based car position reference system attached to the hoistway wall.

FIGS. 3A and 3B are schematic diagrams showing the principle of a hoistway-based car position reference system 40 as used in an elevator system 10. The hoistway-based car position reference system is configured to detect the position of the elevator car 12, or the position of any component fixedly coupled to the elevator car 12, relative to the hoistway 26. FIG. 3A is a highly schematic diagram of a portion 10A of the elevator system 10 showing the hoist machine 18 including the traction sheave 36, the tension member 16, the counterweight 14, and the elevator car 12. The elevator car 12 includes a car position sensing unit of the hoistway-based car position reference system 40. The car position sensing unit includes a car position sensor 42. FIG. 3B is a further highly schematic diagram of a further portion 10B of the elevator system 10 showing a hoistway wall 26A, a number of landings L1, L2, L3 and a number of landing position indicators 44, 46, 48. Each landing position indicator 44, 46, 48 is associated with a respective landing L1, L2, L3. The landing position indicators 44, 46, 48 are attached to the hoistway wall 26A at respective positions corresponding to each landing L1, L2, L3. Each landing position indicator 44, 46, 48 extends in vertical direction from a first predetermined distance X1 below the position of the corresponding landing L1, L2, L3 to a second predetermined distance X2 above the corresponding landing L1, L2, L3. The landing position indicators 44, 46, 48 may be arranged symmetrically with respect to the landings L1, L2, L3, as shown in FIG. 3B. Then, the first and second distances X1 and X2 may be equal to each other. In other configurations, the landing position indicators may be arranged asymmetrically with respect to the landings L1, L2, L3. Then, the first and second distances X1 and X2 will usually not be equal to each other. Similarly, the first and second distances X1 and X2 will not be equal to each other in case the car does not stop exactly in the middle between the opposite ends of a respective landing position indicator. The landing position indicators have the function of car position switching elements 44, 46, 48 of the hoistway-based car position reference system 40. Each landing position indicator 44, 46, 48 may include switching elements at its respective opposite ends along the extension of the hoistway 26. The distance between the portions 10A and 10B of the elevator system 10 shown in FIGS. 3A and 3B are arbitrary. In reality, this distance will be set in such a way that the car mounted position sensor 42 can interact with the landing position indicators 44, 46, 48 when passing the landing position indicators 44, 46, 48.

The hoistway-based car position reference system 40 is used in conjunction with the elevator system 10 to accurately determine the position of the elevator car 12 within the hoistway 26 as directly as possible. The hoistway-based car position reference system 40 includes at least one car position sensor 42 mounted to the elevator car 12. The car mounted car position sensor 42 may be located at any position on the elevator car 12, such as at the top or bottom of the car 12, for example. In FIG. 3A the car position sensor 42 is mounted to the bottom of the elevator car 12 at a side adjacent to the hoistway wall 26A to which the landing position indicators 44, 46, 48 are mounted.

The hoistway-based car position reference system 40 includes a top landing position indicator 48 located near the top of the elevator hoistway 26, adjacent to the top landing L3 of the elevator system 10, and a bottom landing position indicator 44 located near the bottom of the hoistway 26, adjacent to the bottom landing L1. In conventional elevator systems 10, when the elevator car 12 reaches either the top or the bottom landing position indicator 48, 44, the elevator system 10 registers the absolute position of the elevator car 12 in the hoistway 12. Further, a respective landing position indicator 46 is disposed at each of the other landings L2 in the elevator system 10. In FIG. 3B only one of these landings L2 with its corresponding landing position indicator 46 is shown exemplary. Depending on the number of landings in a building, the number of landing position indicators 46 may be larger than one or zero. In some embodiments, the top or bottom landing position indicators 48, 44 may be very long and even overlapping with one or several of the landings. Each landing position indicator 44, 46, 48 may be mounted, for example, to a respective landing door strut or door sill using a known mounting device such as a mounting bracket. An advantage of mounting the landing position indicators 44, 46, 48 to the landing door struts or door sills is that the position of the landing position indicators 44, 46, 48 would change together with the settling of the building, but the distance of the landing position indicator with respect to the respective landing L1, L2, L3 would remain constant. Thus, the landing position indicators provide a direct indication of the position of the elevator car with respect to each landing L1, L2, L3. Alternatively, the landing position indicators 44, 46, 48 may be mounted on guide rails guiding movement of the elevator car 12 in the hoistway 26.

The landing position indicators 44, 46, 48 may comprise any suitable position indicators or smart vanes known in the art. The landing position indicators 44, 46, 48 do not need to include any unique identifying information relative to the landing L1, L2, L3 at which the respective landing position indicator 44, 46, 48 is mounted. As such, the hoistway-based car position reference system 40 can be implemented more easily and at a lower cost than systems which rely on indicators that include uniquely identifiable information with respect to the landing L1, L2, L3 to which it is mounted. The landing position indicators 44, 46, 48 indicate to the hoistway-based car position reference system 40 only that the elevator car 12 is at a landing L1, L2, L3, but not at which landing L1, L2, L3.

In one embodiment, the landing position indicators or car position switching elements 44, 46, 48 may have the configuration of mechanical switching elements, e.g. switching vanes. The switching vanes 44, 46, 48 are arranged such that the car position sensor 42 included in the car position sensing unit interacts with the switching vanes 44, 46, 48 when it passes the switching vanes 44, 46, 48. E.g. the switching vanes 44, 46, 48 may have the configuration of cams which move a component of the car mounted switching sensor 42 when the switching sensor 42 passes the switching vanes, thereby indicating the absolute position of the elevator car 12 relative to the respective one of the landings L1, L2, L3 each time the cam of one of the switching vanes 44, 46, 48 actuates the car mounted switching sensor 42. In other embodiments, the landing position indicators or car position switching elements 44, 46, 48 may be magnetic or optical vanes. In an embodiment where the landing position indicators 44, 46, 48 are magnetic, the car mounted position sensor 42 may be a Hall Effect device that produces an electrical output signal when placed in close proximity to a magnet. In an embodiment where the landing position indicators 44, 46, 48 are optical vanes, the car mounted position sensor 42 may be an optical sensor that uses light reflected off of the optical vane to determine a position of the elevator car 12 relative to a landing L1, L2, L3. As illustrated in FIGS. 3A and 3B, the car mounted position sensor 42 and the landing position indicators 44, 46, 48 are arranged such that the car mounted position sensor 42 is disposed near one of the plurality of landing position indicators 44, 46, 48 when the elevator car 12 is located at the respective landing L1, L2, L3. By orienting the car mounted sensor 42 such as to face the landing position indicators 44, 46, 48, the car mounted position sensor 42 can detect the presence of each landing position indicator 44, 46, 48 as the elevator car 12 and the car mounted sensor 42 travel up and down within the hoistway 26.

The hoistway-based car position reference system 40 described above may be used to determine whether the elevator car 12 has moved vertically, i.e. upwards or downwards, in the hoistway 26 during a period where the elevator car 12 was intended to remain stationary at position in the hoistway 26, particularly at one of the landings L1, L2, L3. In such situation, the brake 32 is engaged such that rotation of the traction sheave 36 is blocked. However, it may happen that the tension member 16 slips over the traction sheave 36 under an imbalance created by the different weights of the counterweight 16 and the car 12 including its load. Particularly, in case of polymer coated tension members 16 it has been observed that under certain conditions the frictional engagement of the tension member with a traction surface 38 of the traction sheave 36 changes when the tension member 16 engages the traction surface 38 statically over an extended period of time.

Figure 4:
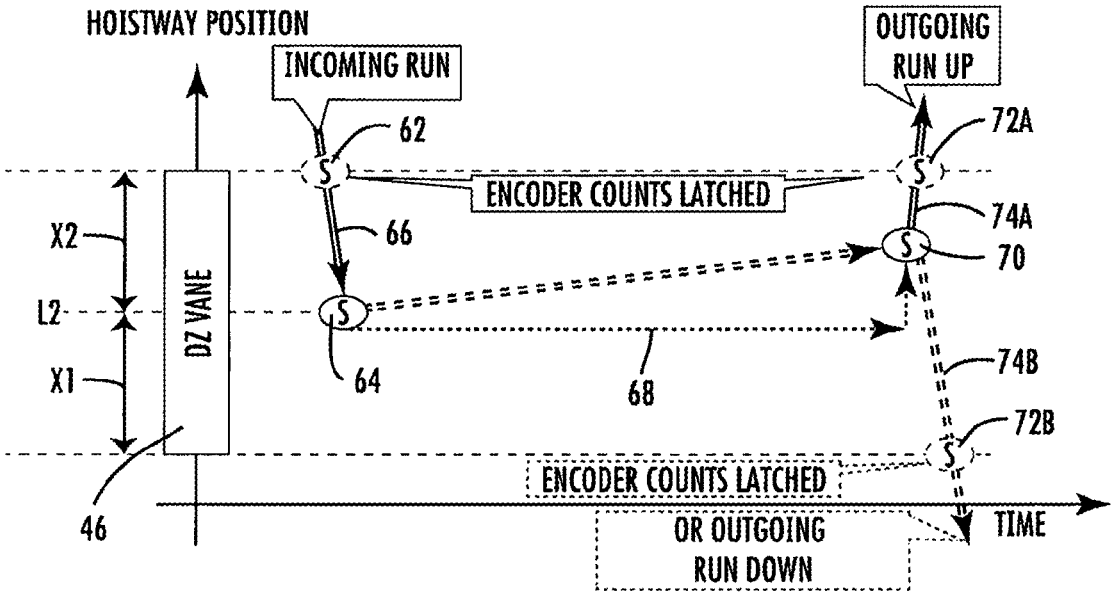
FIG. 4 is a schematic sketch illustrating the basic way of monitoring whether the elevator car has moved upwards or downwards during a holding period.

FIG. 4 is a schematic sketch illustrating the principle way of monitoring whether the elevator car 12 has moved upwards or downwards during a holding period. In FIG. 4 an exemplary situation is illustrated where the elevator car 12 approaches a destination landing L2 while moving in downward direction, stays at the destination landing L2 for a holding period 68 and then leaves the destination landing L2 in upward direction. It goes without saying that corresponding considerations are applicable with respect to other scenarios.

When the elevator car 12 approaches the destination landing (e.g. the landing L2 in FIG. 3B), the hoistway-based car position reference system 40 produces a first trigger signal when the car mounted position sensor 42 of the hoistway-based car position reference system 40 starts to interact with the landing position indicator 46 associated with the destination landing L2. This situation is marked by the reference number 62 in FIG. 4. The elevator car 12 further approaches the destination landing L2, and finally stops at the destination landing L2. This situation is marked by the reference number 64 in FIG. 4. In the time between 62 and 64 the elevator car 12 travels a distance X2 in the hoistway 26. This travel distance X2 can be detected by the further machine-based car position reference system 20 including the car position encoder detecting rotation of the traction sheave 36 or drive shaft 34, or by any other car position reference system being configured to detect rotation of the hoist machine 18, while the elevator car 12 travels along the hoistway 26. Detecting the signal delivered by the further machine-based car position reference system 20 in between the time 62 where the first trigger signal is produced and the time 64 where the elevator car 12 stops at the destination landing L2 delivers a first indicator 66.

Once the elevator car 12 has reached the destination landing L2, it stops at the destination landing L2 for a holding period. The holding period is marked by the reference number 68 in FIG. 4. During the holding period 68, the elevator brake 32 is engaged and thus the elevator car 12 is intended to remain stationary at the destination landing L2. At the end of the holding period 68, the elevator car 12 has received another call and starts moving towards another landing. This situation is marked by the reference number 70 in FIG. 4. When the elevator car 12 starts to move after the end of the holding period 68, the interaction between the car mounted position sensor 42 of the hoistway-based car position reference system 40 and the landing position indicator 46 continues until the elevator car 12 reaches again a position in the hoistway 26 where the landing position indicator 46 ends. Depending on whether the elevator car 12 moves in upward direction or moves in downward direction, this situation is marked by the reference number 72A or 72B in FIG. 4. At the time 72A or 72B, the hoistway-based car position reference system 40 delivers a second trigger signal. In the time between 70 and 72A or 72B the elevator car 12 travels a distance in the hoistway 26. This travel distance can again be detected by the further machine-based car position reference system 20. Detecting the signal delivered by the further machine-based car position reference system in between the time 70 where the elevator car 12 starts to move after the holding period 68 and the time 72A or 72B where the second trigger signal is produced by the hoistway-based car position reference system 40 delivers a second indicator 74A or 74B (depending on whether the elevator car moves in upward direction or in downward direction). In case the elevator car 12 has remained stationary at the position of the landing L2 during the holding period 68, the second indicator 74A or 74B should be equal to the first indicator 66. In case the second indicator 74A is smaller than the first indicator 66 and the elevator car 12 moves in upward direction after the holding period 68, this indicates that the elevator car 12 has moved vertically upwards during the holding period. Correspondingly, in case the second indicator 74A is larger than the first indicator 66 and the elevator car 12 moves in downward direction after the holding period 68, this indicates that the elevator car 12 has moved vertically upwards during the holding period 68. Such upward movement is an indication that the tension member 16 has slipped over the traction surface of the traction sheave during the holding period 68.

A downward movement of the elevator car 12 during the holding period 68 is possible as well in case elevator car 12 is heavier than the counterweight 14. Such movement of the elevator car 12 might be detected by the second indicator 74A being larger than the first indicator 66 in case the elevator car 12 approaches the landing L2 from above and leaves the landing L2 in upward direction. Correspondingly, such movement of the elevator car 12 might be detected by the second indicator 74B being smaller than the first indicator 66 in case the elevator car 12 approaches the landing L2 from above and leaves the landing L2 in downward direction.

Configurations are conceivable as well in which the landing position indicator vane 46 is positioned asymmetrically with respect to its corresponding landing L2. In such configurations, opposite ends of the landing position indicator 46, which cause switching interaction with the car mounted sensor 42 of the hoistway-based car position reference system 40, have different distances X1, X2 to the position of the landing L2. In such configurations, the distance X1 between the position of the landing L2 and the lower end of the corresponding landing position indicator vane 46 will be different from the distance X2 between the position of landing L2 and the upper end of the corresponding landing position indicator vane 46, and therefore the predetermined difference between the first indicator 66 and the second indicator 74A or 74B will be different from zero in case the elevator car 12 approaches the landing L2 from above, remains stationary at the landing L2 during the holding period 68, and leaves the landing L2 in downward direction after the holding period 68 (or vice versa). In such case, the elevator car 12 is determined to have remained stationary in the hoistway 26 during the holding period 68 in case the difference between the first indicator 66 and the second indicator 74A or 74B corresponds to the predetermined difference. The elevator car 12 is determined to have moved along the hoistway 26 during the holding period 68 in case the difference between the first indicator 66 and the second indicator 74A or 74B differs from the predetermined difference, i.e. is smaller or larger than the predetermined difference.

Embodiments as disclosed above provide an elevator control system and an elevator system which allows to detect whether the frictional engagement between the traction sheave and the tension member is sufficiently large to prevent movement of the car upwards or downwards in the hoistway in a situation where the elevator car should stop at a desired position in the hoistway, even in situation where the car is intended to remain at one position in the hoistway over an extended period of time.

Embodiments described herein provide an elevator control system, comprising an elevator control system configured to control movement of an elevator car along an elevator hoistway between a starting position and a destination position, the control system comprising a car holding position monitoring unit configured to monitor whether the elevator car has moved upwards or downwards in the hoistway during a holding period. The car holding position monitoring unit is configured to: Receive a first trigger signal from a first car position reference system; upon receipt of the first trigger signal, receive a signal from a further car position reference system to detect a first indicator indicative of the travel distance between the position of the elevator car in the hoistway when receiving the first trigger signal and the position of the elevator car in the hoistway when stopping at the destination position; upon receipt of a further service call for the elevator car, receive a further signal from the further car position reference system and a second trigger signal from the first car position reference system to detect a second indicator indicative of a travel distance between the position of the elevator car in the hoistway at the end of the holding period and the position of the elevator car in the hoistway when the elevator car receives the second trigger signal from the first car position reference system; and detect whether the elevator car has moved during the holding period based on a comparison of the first indicator and the second indicator.

The term hoistway is used herein in a general sense also including glass hoistways or panoramic elevators where the elevator car is moving along a vertical path without being confined by hoistway walls on one side or on a plurality of sides.

The holding period is a period during which the elevator car was intended to remain stationary at the destination position. Typically, the elevator car will be secured by engaging a holding brake of the elevator system. In embodiments, the holding brake may engage the drive machine of the elevator system, e.g. a drive sheave or a drive shaft. Unwanted vertical movement of the elevator car may occur in case the tension member slips over the traction sheave, although rotation of the traction sheave is blocked by a holding brake.

The second indicator indicates a travel distance between a position in the hoistway reached by the elevator car at the end of the holding period and the position in the hoistway reached by the elevator car in when receiving the second trigger signal. During the holding period, the elevator car is intended to remain stationary at the destination position. In such case, the second indicator will have a predetermined value corresponding to a distance between the destination position and the position of the switching element of the first car position reference system in the hoistway producing the second trigger signal. In case the elevator car reaches the destination position while travelling in one direction, and leaves the destination position travelling in the opposite direction than the direction from which the elevator car has approached the destination position, the first trigger signal and the second trigger signal may be produced when the elevator car passes the same switching element of the first car position reference system. In that case, the first and second indicator should be equal when the elevator car has remained stationary in the hoistway during the holding period. Therefore, in case no difference is detected between the first indicator and the second indicator, this indicates that the elevator car has indeed not moved along the hoistway during the holding period, and thus that no slip of the tension member on the traction sheave has occurred. Any non-zero difference between the first indicator and the second indicator will indicate that the elevator car has moved along the hoistway during the holding period, e.g. because of a slip phenomenon of the tension member with respect to the traction sheave occurred during the holding period, causing the elevator car to move upwards or downwards in the hoistway during the holding period. As set out above, such slip phenomenon may occur particularly in traction drive elevators where a tension member with a polymer coating (e.g. a polyurethane coating) is used, like in the case of a traction drive elevator using coated steel belt tension members.

In cases where the second trigger signal is produced when the elevator car passes a different switching element of the first car position reference system than the switching element producing the first trigger signal, the first indicator and the second indicator may differ from each other by a predetermined difference when the car has remained stationary in the hoistway during the holding period. The predetermined difference is dependent on the distance of the respective switching elements of the first car position reference system from the landing position. One example might be an embodiment where opposite ends of a landing position indicator vane are used as the switching elements of the first car position reference system and the landing position indicator vane is mounted asymmetrically with respect to the landing such that its upper end has a different distance to the landing position than its lower end. In such configuration the predetermined difference between the first indicator and the second indicator will be different from zero in case the car approaches the landing from above and leaves the landing downward (or vice versa). Movement of the elevator car during the holding period is detected by determining whether the difference bet ween the first indicator and the second indicator corresponds to the predetermined difference (in which case the elevator car is determined to have remained stationary), or whether such difference differs from the predetermined difference (in which case the elevator car is determined to have moved).

The first car position reference system and the further position reference system not necessarily need to be separate systems. The first car position system may be configured to detect movement of the elevator car, or of a component directly coupled to the elevator car, with respect to the hoistway as directly as possible. Therefore, the first car position reference system may be referred to as a hoistway-based car position reference system. In most cases, the first car position reference system will be configured such as to deliver signals when the elevator car passes predetermined reference positions in the hoistway. Typically, the vertical resolution of such hoistway-based car position reference system will be relatively coarse, e.g. only delivering one or two trigger signals indicating that a particular landing is approached or has been passed. The further position reference system may be configured to deliver a signal representing the position of car with a high vertical resolution, often even continuously or quasi-continuously, when the car is moving along the hoistway. For example, the further car position reference system may be a machine-based car position reference system configured to detect movement of at least one component of a hoist machine driving the elevator car. Thus, the further car position reference system will provide an indication of the position of the car in the hoistway in a more indirect way by detecting motion of a component of the hoist machine. Both systems may be identical in case the first car position reference system is able to deliver signals representing the position of the car in the hoistway with sufficiently high vertical resolution, e.g. in elevator systems comprising a governor mounted encoder for detecting the position of the car in the hoistway.

The car holding position monitoring unit may be implemented as a software function in the elevator control system. The software function may compare encoder counts delivered by a machine-based car position reference system at entry of the elevator car into a landing position indicator vane of a hoistway-based car position reference system until the elevator car stops at the destination landing to encoder counts counted at next exit of the elevator car from the destination landing, after the elevator car starts moving again until it reaches again the end of the landing position indicator vane. Large discrepancies to the expected count after large rest periods indicate a slip issue of the tension member with respect to the traction sheave and may be used to activate countermeasures. The extent of discrepancies may also be useful in dimensioning countermeasures. This allows to identify and address any potential safety hazards before they become apparent to passengers. A particular benefit is that countermeasures need to be invoked only at installation and in situations where a tension member slip phenomenon has occurred and avoids penalizing other elevator systems with countermeasures that are not needed.

Particular embodiments may include any of the following optional features, alone or in combination:

In embodiments the car holding position monitoring unit may be configured to detect that the elevator car has moved along the hoistway during the holding period in case a difference between the first indicator and the second indicator differs from a predetermined difference. The predetermined difference may be zero in configurations where the first trigger signal and the second trigger signals are produced when the elevator car has the same distance to the destination position. However, configurations are conceivable as well where the predetermined difference is non-zero because the first trigger signal is produced when the elevator car has a larger or smaller distance to the destination position than the distance of the elevator car to the destination position when the second trigger signal is produced.

In embodiments, the hoistway-based car position reference system may comprise a plurality of switching elements configured to interact with a sensor mounted to the elevator car, each of the switching elements being positioned at a predetermined position along the hoistway. The switching elements may be landing position indicators of a conventionally known hoistway-based car position reference system.

The switching elements may be mechanical switches (e.g. vanes interacting with a switch as a sensor), magnetic switches, electrical switches, optical switches or other switches mounted to the hoistway walls at predetermined vertical positions. A corresponding sensor unit may be mounted to the elevator car such as to create a trigger signal when the elevator car passes one of the switching elements during its movement in the hoistway. Often, such switching elements are used to detect that the car approaches one of the landings and to initiate deceleration of the elevator car when it approaches a destination landing.

In embodiments, the destination position may be a landing position in the hoistway and the hoistway-based car position reference system may be a landing position reference system.

In embodiments, the trigger signal may indicate that the elevator car is approaching the destination landing and the further trigger signal may indicate that the elevator car has left the destination landing.

In embodiments, the further position reference system may be a machine-based position reference system. For example, the further position reference system may be configured to detect rotation of the traction sheave or drive motor. For example, the further position reference system may have the configuration of an encoder detecting rotation of a drive shaft of the drive motor. The traction sheave is rotationally coupled with the drive shaft of the drive motor. The encoder may by a magnetic encoder, an optic encoder, or the like.

In embodiments, the elevator control system may be configured to suppress opening the car doors and/or landing doors in case it is detected that the elevator car has moved in the hoistway during the holding period by an offset distance equal to or larger than a predetermined threshold. This avoids any potential safety hazards to passengers entering the elevator car in case the elevator car has moved, e.g., for several centimeters during the holding period and a step is created between the floor the landing and the floor of the elevator car. For example, opening the car doors and/or landing doors may be suppressed each time the car has stopped at a landing for a predetermined holding period or longer, in case occurrence of a movement of the elevator car in the hoistway during the holding period by an offset distance equal to or larger than a predetermined threshold has been detected at a previous stop.

In order to remove such step, a re-leveling operation may be initiated in case the car holding position monitoring unit detects that the elevator car has moved in the hoistway during the holding period. As a more simple countermeasure the elevator control system may be configured to perform a correction movement of the elevator car in the hoistway before opening the car doors and/or the landing doors in case the car holding position monitoring unit detects that the elevator car has moved in the hoistway during the holding period. For example, a correction movement may be as simple as driving the elevator car to another landing and back to the landing from where it started before opening the car door and the landing doors such that passengers can enter the car. Any step will have disappeared after the correction movement has been completed. For example, a correction movement of the car may be carried out each time the elevator car has stopped at a landing for a predetermined holding period or longer, in case occurrence of a movement of the elevator car in the hoistway during the holding period by an offset distance equal to or larger than a predetermined threshold has been detected at a previous stop.

In embodiments, the elevator control system may be configured to evaluate the offset distance of the elevator car during the holding period as a function of the duration of the holding period. Such evaluation may be used to identify elevators where a slip phenomenon occurs and may also be used to determine the extent of the slip phenomenon. If necessary, specific maintenance procedures may be scheduled for an elevator system based on the evaluation. This scheduling may be done automatically by the elevator control system. Maintenance schedules may be modified automatically (e.g. specific extraordinary maintenance tasks may be created by the elevator control system).

Further embodiments may include an elevator system comprising a drive machine, a tension member coupled to the drive machine and to an elevator car, such as to move the elevator car in vertical direction between landings, and an elevator control system according to any of the previous claims. In embodiments, the elevator system may be a traction drive elevator system comprising a drive machine having a traction sheave rotationally coupled to a drive motor, the tension member running over the traction sheave and frictionally engaging a traction surface of the traction sheave in its section running over the traction sheave; the elevator system further comprising a holding brake engaging the drive machine for holding the elevator car at a desired position. In embodiments, the holding brake may be configured to engage the traction sheave or a drive shaft to which the traction sheave is rotationally coupled.

Further embodiments disclosed herein relate to a method of controlling movement of an elevator car along an elevator hoistway between a starting position and a destination position, the method comprising monitoring whether the elevator car has moved upwards or downwards in the hoistway during a holding period by carrying out the following steps: Receiving a trigger signal from a first car position reference system; upon receipt of the trigger signal, receiving signals from a further car position reference system to detect a first indicator indicative of a travel distance between the position of the elevator car in the hoistway when receiving the trigger signal and the position of the elevator car in the hoistway when stopping at the destination position, upon receipt of a further service call for the elevator car, receiving further signals from the further car position reference system and receiving a second trigger signal from the first car position reference system to detect a second indicator indicative of a travel distance between the position of the elevator car in the hoistway at the end of the holding period and the position of the elevator car in the hoistway when the elevator car receives the further trigger signal from the first car position reference system; and detecting whether the elevator car has moved during the holding period based on a comparison of the first indicator and the second indicator.

In embodiments, the method further may comprise detecting that the elevator car has moved along the hoistway during the holding period in case a difference between the first indicator and the second indicator differs from a predetermined difference.

In embodiments, the destination position may be a landing position in the hoistway, the first car position reference system may be a hoistway-based car position reference systems, e.g. a landing position reference system, and the trigger signal indicates that the elevator car is approaching the destination landing.

In embodiments, the further position reference system may be a machine-based car position reference system configured to detect movement of at least one component of a hoist machine driving the elevator car.

In embodiments, the method further may comprise suppressing opening the car doors and/or landing doors in case it is detected that the elevator car has moved in the hoistway during the holding period by an offset distance equal to or larger than a predetermined threshold.

In embodiments, the method further may comprise performing a correction movement of the elevator car in the hoistway before opening the car doors and/or the landing doors.

In embodiments, the method further may comprise evaluating the offset distance of the elevator car during the holding period as a function of the duration of the holding period.

While the invention has been described by taking reference to specific exemplary embodiments, it is to be understood that the invention is not limited to these embodiments and is defined by the scope of the appended claims.

LIST OF REFERENCE SIGNS

10: Elevator system
12: Elevator car
14: Counterweight
16: Tension member
18: Hoist machine
20: Machine-based car position reference system
22: Limit Switch
24: Elevator controller
26: Hoistway
L1: Landing
L2: Landing
L3: Landing
30: Drive motor
32: Brake
34: Drive shaft
36: Traction sheave
38: Traction surface
40: Hoistway-based car position reference system
42: Car mounted position reference sensor
44: Landing position indicator
46: Landing position indicator
48: Landing position indicator
62: First trigger signal is received

64: Elevator car reaches destination landing L2
66: First indicator
68: Holding period
70: End of Holding period
72A/72B: Second trigger signal received
74A/74B: Second indicator
X1: Distance between position of landing and upper end of the corresponding landing position indicator (=first switching element of the hoistway-based car position reference system)
X2: Distance between position of landing and lower end of the corresponding landing position indicator (=second switching element of the hoistway-based car position reference system)

The invention claimed is:

1. An elevator control system configured to control movement of an elevator car (12) along a hoistway (26) between a starting position and a destination position (L2), the control system comprising a car holding position monitoring unit configured to monitor whether the elevator car (12) has moved upwards or downwards in the hoistway (26) during a holding period (68);

the car holding position monitoring unit being configured to:

receive a first trigger signal (62) from a first car position reference system (40), upon receipt of the first trigger signal (62), receive a signal from a further car position reference system to detect a first indicator (66) indicative of the travel distance (X2) between the position of the elevator car (12) in the hoistway (26) when receiving the first trigger signal (62) and the position of the elevator car (12) in the hoistway (26) when stopping at the destination position (64), upon receipt of a further service call for the elevator car (12), receive a further signal from the further car position reference system and a second trigger signal (72A, 72B) from the first car position reference system (40) to detect a second indicator (74A, 74B) indicative of a travel distance between the position of the elevator car (12) in the hoistway (26) at the end of the holding period (68) and the position of the elevator car (12) in the hoistway when the elevator car (12) receives the second trigger signal (72A, 72B) from the first car position reference system (40); and detect whether the elevator car (12) has moved during the holding period (68) based on a comparison of the first indicator (66) and the second indicator (74A, 74B).

2. The elevator control system according to claim 1, wherein the car holding position monitoring unit is configured to detect that the elevator car (12) has moved in the hoistway (26) during the holding period (68) in case a difference between the first indicator (66) and the second indicator (74A, 74B) differs from a predetermined difference.

3. The elevator control system according to claim 1, wherein the first car position reference system (40) is a hoistway-based car position reference system.

4. The elevator control system according to claim 3, wherein the first car position reference system (40) comprises a plurality of switching elements (44, 46, 48) configured to interact with a sensor (42) mounted to the elevator car (12), each of the switching elements (44, 46, 48) being positioned at a predetermined position (L1, L2, L3) along the hoistway (26).

5. The elevator control system according to claim 1, wherein the destination position (L2) is a landing position (L1, L2, L3) in the hoistway (26) and the first car position reference system (40) is a landing position reference system.

6. The elevator control system according to claim 5, wherein receiving the first trigger signal (62) indicates that the elevator car (12) is approaching the destination landing (L2) and receiving the second trigger signal (72A, 72B) indicates that the elevator car (12) has left the destination landing (L2).

7. The elevator control system according to claim 1, wherein the further position reference system is a machine-based car position reference system configured to detect movement of at least one component (30, 34, 36, 38) of a hoist machine (18) driving the elevator car (12).

8. The elevator system according to claim 7, wherein the further position reference system detects rotation of the traction sheave (36) or drive motor (30).

9. The elevator control system according to claim 1, being configured to suppress opening the car doors and/or landing doors in case it is detected that the elevator car (12) has moved in the hoistway (26) during the holding period (68) by an offset distance equal to or larger than a predetermined threshold.

10. The elevator control system according to claim 9, being configured to perform a correction movement of the elevator car (12) in the hoistway (26) before opening the car doors and/or the landing doors.

11. The elevator control system according to claim 1, being configured to evaluate the offset distance of the elevator car (12) during the holding period (68) as a function of the duration of the holding period (68).

12. An elevator system (10) comprising a hoist machine (18), a tension member (16) coupled to the hoist machine (18) and to an elevator car (12), such as to move the elevator car (12) in vertical direction between landings (L1, L2, L3), and an elevator control system according to claim 1.

13. The elevator system (10) according to claim 12, wherein the elevator system (10) is a traction drive elevator system comprising a hoist machine (18) having a traction sheave (36) rotationally coupled to a drive motor (30), the tension member (16) running over the traction sheave (36) and frictionally engaging a traction surface (38) of the traction sheave (36) in its section running over the traction sheave (36); the elevator system (10) further comprising a holding brake (32) engaging the hoist machine (18) for holding the elevator car (12) at a desired position.

14. A method of controlling movement of an elevator car (12) along a hoistway (26) between a starting position and a destination position (L2), the method comprising monitoring whether the elevator car (12) has moved upwards or downwards in the hoistway (26) during a holding period (68) by carrying out the following:

receiving a first trigger signal (62) from a first car position reference system (40), upon receipt of the first trigger signal, receiving signals from a further car position reference system to detect a first indicator (66) indicative of a travel distance (X2) between the position of the elevator car (12) in the hoistway (26) when receiving the first trigger signal (62) and the position of the elevator car (12) in the hoistway (26) when stopping at the destination position (64), upon receipt of a further service call for the elevator car (12), receiving further signals from the further car position reference system and receiving a second trigger signal (72A) from the first car position reference system (40) to detect a second indicator (74A) indicative of a travel distance between the position of the elevator car (12) in the hoistway (26) at the end of the holding period (68) and the position of the elevator car (12) in the hoistway (26) when the elevator car (12) receives the second trigger signal (72A) from the first car position reference system (40); and detecting whether the elevator car (12) has moved during the holding period (68) based on a comparison of the first indicator (66) and the second indicator (74A).

15. The method according to claim 14, further comprising:

detecting that the elevator car (12) has moved in the hoistway (26) during the holding period (68) in case a difference between the first indicator (66) and the second indicator (70A) differs from a predetermined difference.

16. The method according to claim 14, wherein the destination position (L2) is a landing position (L1, L2, L3) in the hoistway (26), the first car position reference system (40) is a landing position reference system, and receiving the first trigger signal (62) indicates that the elevator car (12) is approaching the destination landing (L2), and receiving the second trigger signal (72A, 72B) indicates that the elevator car (12) has left the destination landing (L2).

17. The method according to claim 14, wherein the further position reference system (22) is a machine-based position reference system configured to detect movement of at least one component (30, 34, 36, 38) of a hoist machine (18) driving the elevator car (12).

18. The method according to claim 14, further comprising:

suppressing opening the car doors and/or landing doors in case it is detected that the elevator car (12) has moved in the hoistway (26) during the holding period (68) by an offset distance equal to or larger than a predetermined threshold.

19. The method according to claim 18, further comprising:

performing a correction movement of the elevator car (12) in the hoistway (26) before opening the car doors and/or the landing doors.

20. The method according to claim 14, further comprising:

evaluating the offset distance of the elevator car (12) during the holding period (68) as a function of the duration of the holding period (68).

* * * * *